US005499809A

United States Patent [19]

Takemoto et al.

[11] Patent Number: 5,499,809

[45] Date of Patent: Mar. 19, 1996

[54] BANK NOTE CONVEYING APPARATUS

[75] Inventors: Takatoshi Takemoto; Toshikazu Chida, both of Tokyo; Noriaki Kano, Hanamaki; Eiji Ito, Hanamaki; Koji Murakami, Hanamaki; Takashi Itagaki, Hanamaki; Koji Sekimoto, Sendai; Masanori Suzuki, Hanamaki, all of Japan

[73] Assignee: Kabushiki Kaisha Ace Denken, Japan

[21] Appl. No.: 250,755

[22] Filed: May 26, 1994

[51] Int. Cl.[6] ..... B65H 5/02

[52] U.S. Cl. ..... 271/274; 271/275; 271/198

[58] Field of Search ..... 271/273, 274, 271/275, 198; 198/836.2, 721

[56] References Cited

FOREIGN PATENT DOCUMENTS 0005702 12/1979 European Pat. Off. ..... 271/275

61-211249 9/1986 Japan ..... 271/198

1127539 5/1989 Japan ..... 271/273

1-156159 10/1989 Japan .

*Primary Examiner*—David H. Bollinger

*Attorney, Agent, or Firm*—Andrus, Sceales, Starke & Sawall

[57] ABSTRACT

A bank note conveying apparatus provides stable conveyance of bank notes by firmly pinching the bank notes from both sides. The apparatus comprises an endless belt 1 contacting one of the two faces of a bank note A, a belt driving mechanism which rotates the endless belt 1, a ball 2 which is provided to come into contact with the opposite face of the two faces of the bank note, and a holder 4 which supports the ball 2 to rotate freely. The holder 4 comprises a casing 4*a* which houses the ball 2 so that it is movable in the direction to and from the endless belt. A coil spring 7 is provided within the casing 4*a* which pushes the ball 2 in the direction of the endless belt.

8 Claims, 10 Drawing Sheets

BANK NOTE CONVEYING APPARATUS

FIELD OF THE INVENTION

The present invention relates to a bank note conveying apparatus which conveys bank notes, and more particularly to a bank note conveying apparatus which conveys bank notes while pinching the same between a bank note conveying belt and a ball.

DESCRIPTION OF THE RELATED ART

Conventionally, a bank note conveying apparatus comprises, for example, a bank note conveying belt, a belt driving mechanism, a ball provided oppositely to the bank note conveying belt, a holder which supports the ball to be freely rotatable therein, and a leaf spring which urges the holder in a direction to press the ball against the bank note conveying belt. The bank notes are conveyed by the rotation of the conveying belt, while one of the two faces of the bank note is in contact with the bank note conveying belt and the opposite face of the bank note comes into contact with the ball. At this moment, the ball is urged toward the bank note conveying belt by the leaf spring, so that the ball can firmly pinch the bank note in cooperation with the conveying belt.

In general, a leaf spring of a large size has to be used to increase the length of the stroke. However, the bank note conveying apparatus has to be inevitably large in size if a large leaf spring is used. To avoid this, a small leaf spring is used in the conventional bank note conveying apparatus. The length of the stroke is therefore short, so that if the holder and the leaf spring are not mounted accurately, the ball cannot always be pressed against the bank note conveying belt. Further, if the thickness of each of the leaf springs is not strictly controlled, the lengths of the strokes will vary one from another, and the operation for pressing the ball against the bank note conveying belt is not assured. As a result, there may be cases where the bank notes cannot be pinched firmly between the ball and the conveying belt in the prior art, which results in unstable conveyance of the bank notes and gives the problem of increasing the occurrence of jamming.

SUMMARY OF THE INVENTION

In view of the previous problems, the object of the present invention is to provide a bank note conveying apparatus which can stably convey the bank notes by firmly pinching the bank notes between a ball and a conveying belt.

For attaining the above object, the bank note conveying apparatus comprises an endless conveying belt provided to come into contact with one of two faces of the bank note; a belt driving mechanism which rotates the endless conveying belt; a ball provided to come into contact with the opposite face of the two faces of the bank note; and a holder which rotatably supports the ball;

the holder including a casing to house the ball therein, allowing the same to be movable to-and-fro relative to the endless conveying belt, and a coil spring provided within the casing in a compressed condition to urge the ball against the endless belt.

In the bank note conveying apparatus, the bank note has one of its two faces in contact with the endless conveying belt and the opposite face in contact with the ball. The bank note is pressed to the conveying belt by the ball which is urged towards the conveying belt by the coil spring. As a result, the bank note is conveyed with the rotation of the conveying belt. In the present invention, incidentally, the coil spring is used instead of a leaf spring whose stroke length is limited in the thickness and size of the spring, as a resilient member which presses the ball to the bank note conveying belt, so that the stroke length can be set comparatively freely. Therefore, the stroke length of the elastic member and the ball can be increased, and this assures that the ball is pressed to the bank note conveying belt without strictly precise mounting of the holder against the bank note conveying belt. Thus, the bank note is pinched firmly in between the ball and the bank note conveying belt so that stable conveyance of the bank note can be obtained.

It is preferable for the bank note conveying apparatus to comprise a bank note path forming member which controls the position and the direction of the bank note; the bank note conveying path forming member including a first bank note thickness-direction-position guide section which extends to oppose to one of the two faces of the bank note to control the thickness direction position of the bank note, a second bank note thickness-direction-position guide section which extends to oppose to the other face of the two faces of the bank note to control the thickness direction position of the bank note, and a bank note widthwise-position guide section which controls the widthwise position of the bank note; the first bank note thickness-direction-position guide section facing the one of the two faces of the bank note being formed with an opening to allow the bank note conveying belt to come into contact with the one face of the bank note; and the second bank note thickness-direction-position guide section facing the other face of the two faces of the bank note being formed with an opening having a smaller diameter than that of the ball so that the ball will partly but not completely project out towards the bank note conveying belt through the second bank note thickness-direction-position guide section.

When the bank note conveying apparatus is provided with a bank note conveying path forming member as mentioned above, it is preferable for it to comprise a one end supporting member which disengageably supports one end of the bank note conveying path forming member in the widthwise direction of the bank note; and an opposite end supporting member which supports an opposite end of the bank note conveying path forming member so that the above mentioned end is able to swing around the opposite end as a pivot in a direction away from the bank note conveying belt.

When problems such as jamming of bank notes occur within the bank note conveying path forming member in the case as mentioned above wherein the bank note conveying path forming member is provided so that it can swing, the stuck bank note can be easily removed by swinging the bank note conveying path forming member in the direction away from the bank note conveying belt, because the distance from the bank note conveying belt to the bank note conveying path forming member and the ball will be widened.

Further, when the bank note conveying apparatus is provided with a bank note conveying path forming member, the second bank note thickness direction position guide section is preferably curved so that the portion where the opening is formed is bent in the direction away from the bank note conveying belt.

When the second bank note thickness direction position guide section is curved as mentioned above, the pressing operation of the ball to the bank note can be improved so that the bank notes can be conveyed more stably.

Moreover, it is preferable that in the bank note conveying apparatus, the belt driving mechanism comprises a drive pulley and a driven pulley over which the bank note conveying belt can be put; a plurality of gears are mounted at the peripheries of the drive pulley and the driven pulley, respectively; and the outer surface of the bank note conveying belt which comes into contact with the one of the faces of the bank note is formed to be smooth while its inner surface is formed to have ribs to fit the gears of the drive pulley and the driven pulley.

When a so-called timing belt, where the inner surface is formed to have ribs, is used as the conveying belt, the bank notes can be conveyed effectively because the rotation of the drive pulley is transmitted to the conveying belt without any loss.

PREFERRED EMBODIMENTS OF THE INVENTION

An embodiment of the present invention will be explained below, with reference to the figures.

Figure 9:
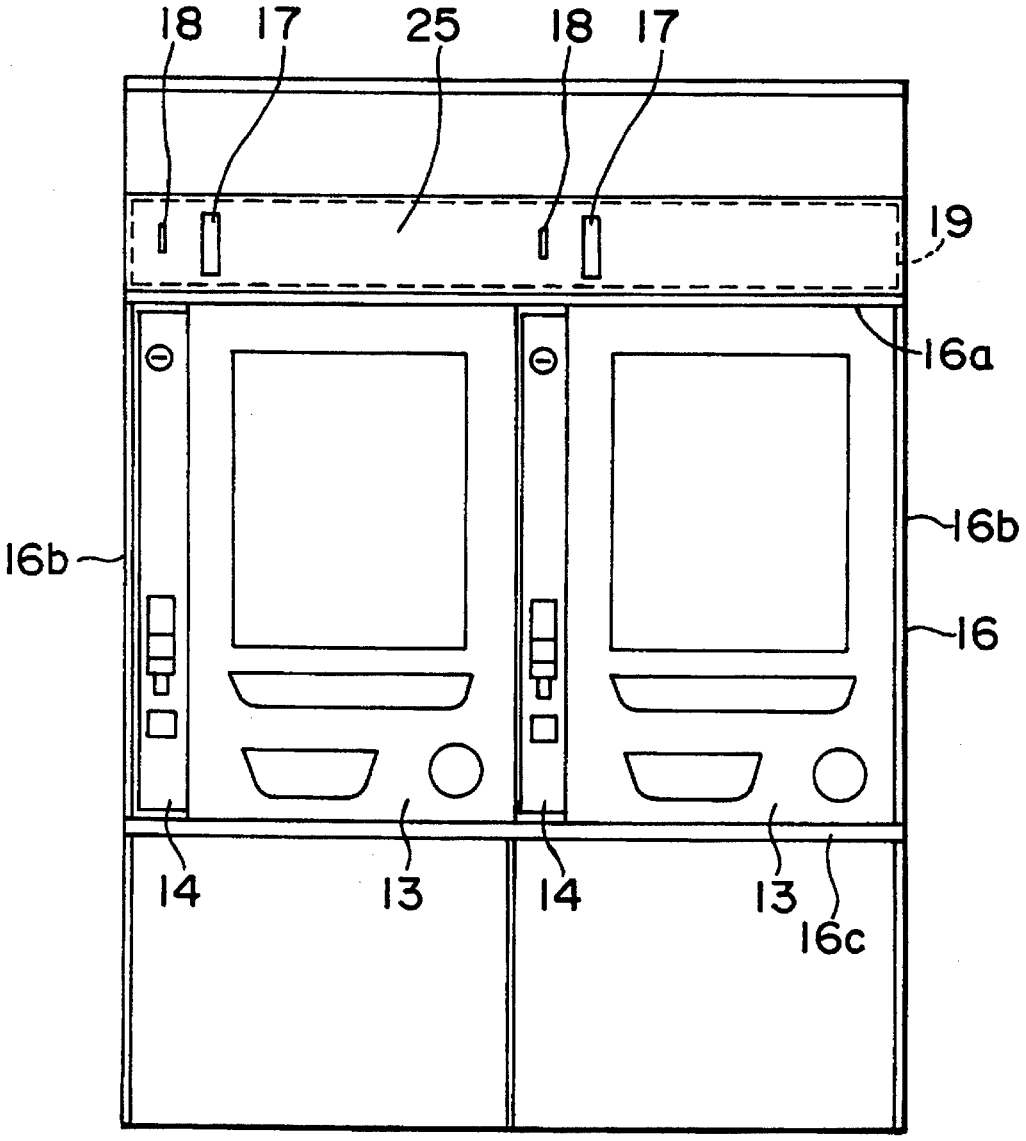
FIG. 9 is a front view of pachinko machines and ball lending machines in combination to form a unit in the embodiment of the present invention.
Figure 10:
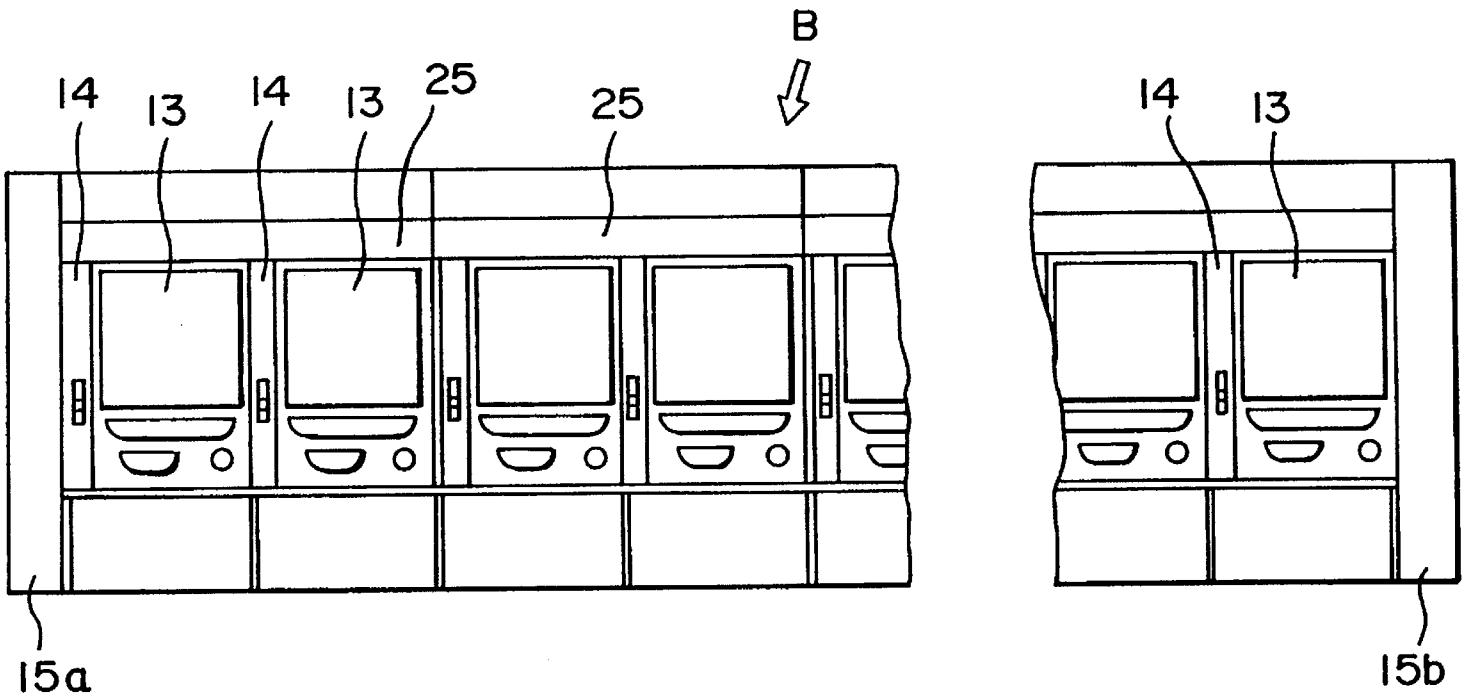
FIG. 10 is a front view of a pachinko island in the embodiment of the present invention.

As shown in FIG. 10, a pachinko island B comprises a number of pachinko machines 13, a number of ball lending machines 14, and island decorations 15*a*, 15*b*, etc. The pachinko machines 13 and the ball lending machines 14 are arranged alternately in a line. At both ends of the line of the pachinko machines 13 and the ball lending machines 14, the island decorations 15*a*, 15*b* are provided, respectively. As shown in FIG. 9, two pachinko machines 13, 13 and two pachinko machines 14, 14 construct one unit. One unit comprising the pachinko machines 13, 13 and the ball lending machines 14, 14 is housed within a unit supporting frame 16. The unit supporting frame 16 comprises a top board 16*a*, a side board 16*b*, and a bottom board 16*c*. A conveying apparatus substrate 19 where a bank note conveying apparatus, a coin conveying apparatus, and a bank note distinction apparatus etc. are provided, is disposed on the top board 16*a* of the unit supporting frame 16. At the front of the substrate 19, a covering board 25 is provided. In the covering board 25, bank note insertion slots 17 and coin insertion slots 18 are formed.

Figure 2:
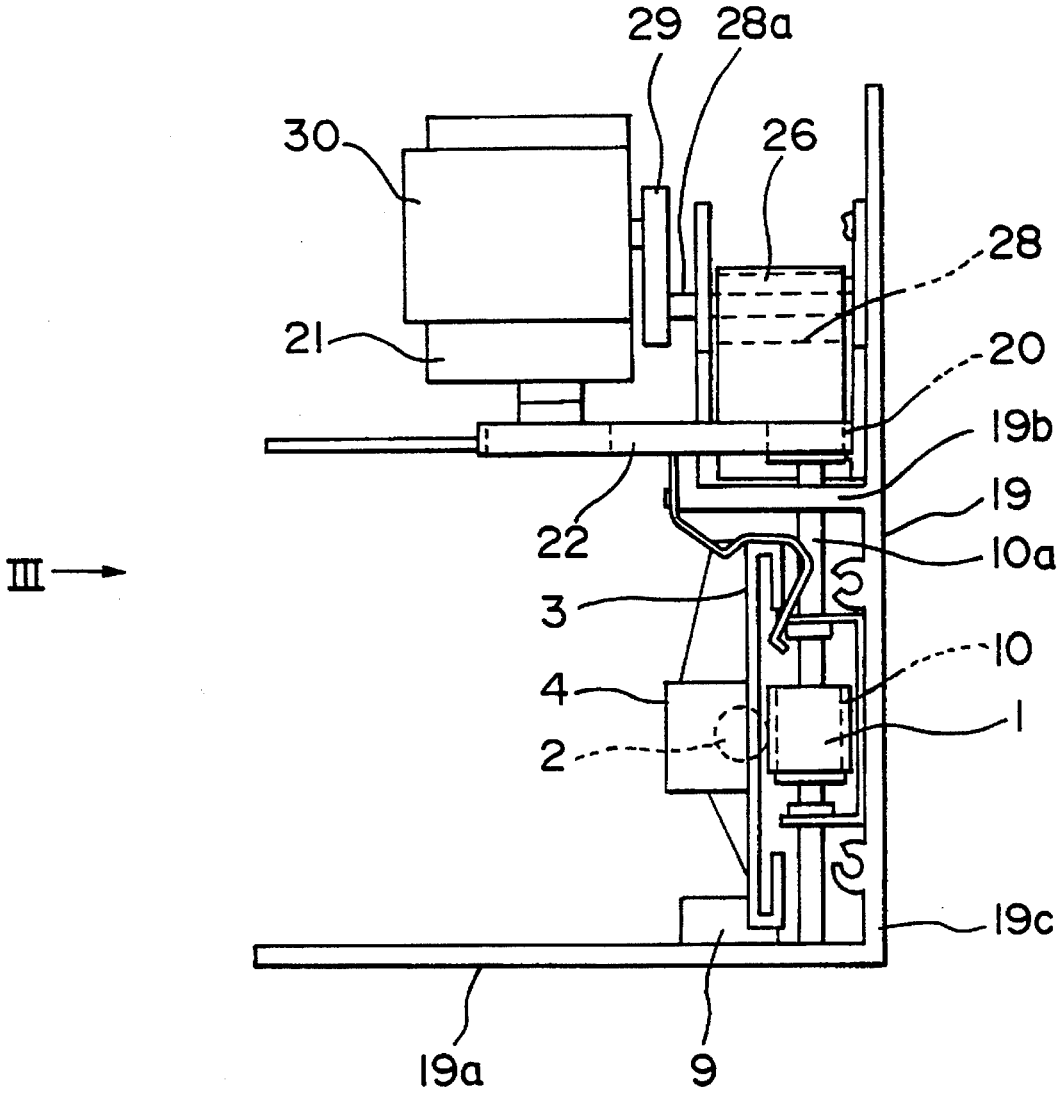
FIG. 2 is a side view of the bank note conveying apparatus and the coin conveying apparatus in the embodiment of the present invention.
Figure 5:
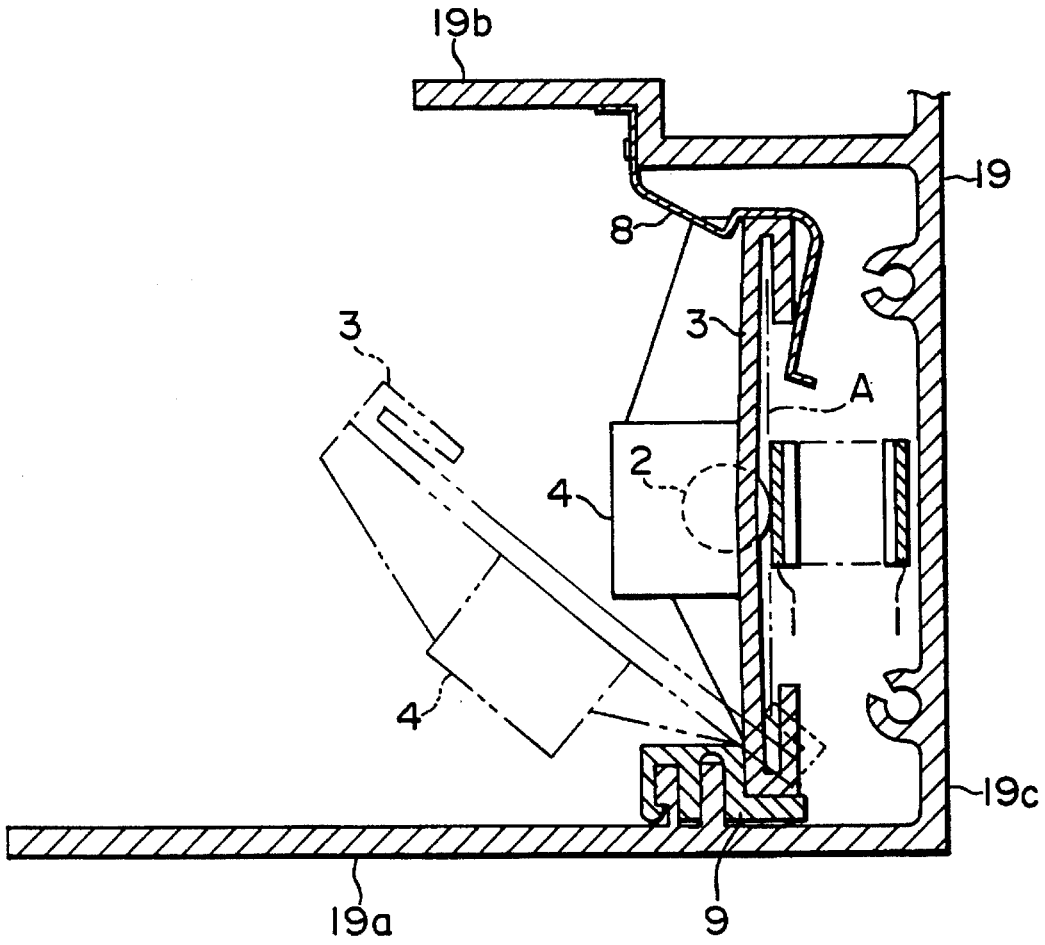
FIG. 5 is a cross sectional view taken along a line V—V of FIG. 4.

The substrate 19, as shown in FIG. 2 and FIG. 5, comprises a base board 19*a* connected to the upper board 16*a* of the unit supporting frame 16, an upright board 19*c* perpendicularly standing at the inner end of the base board 19*c*, and a shelf board 19*b* provided parallel to the base board 19*a* at the middle portion in the lengthwise direction of the upright board 19*c*.

Figure 3:
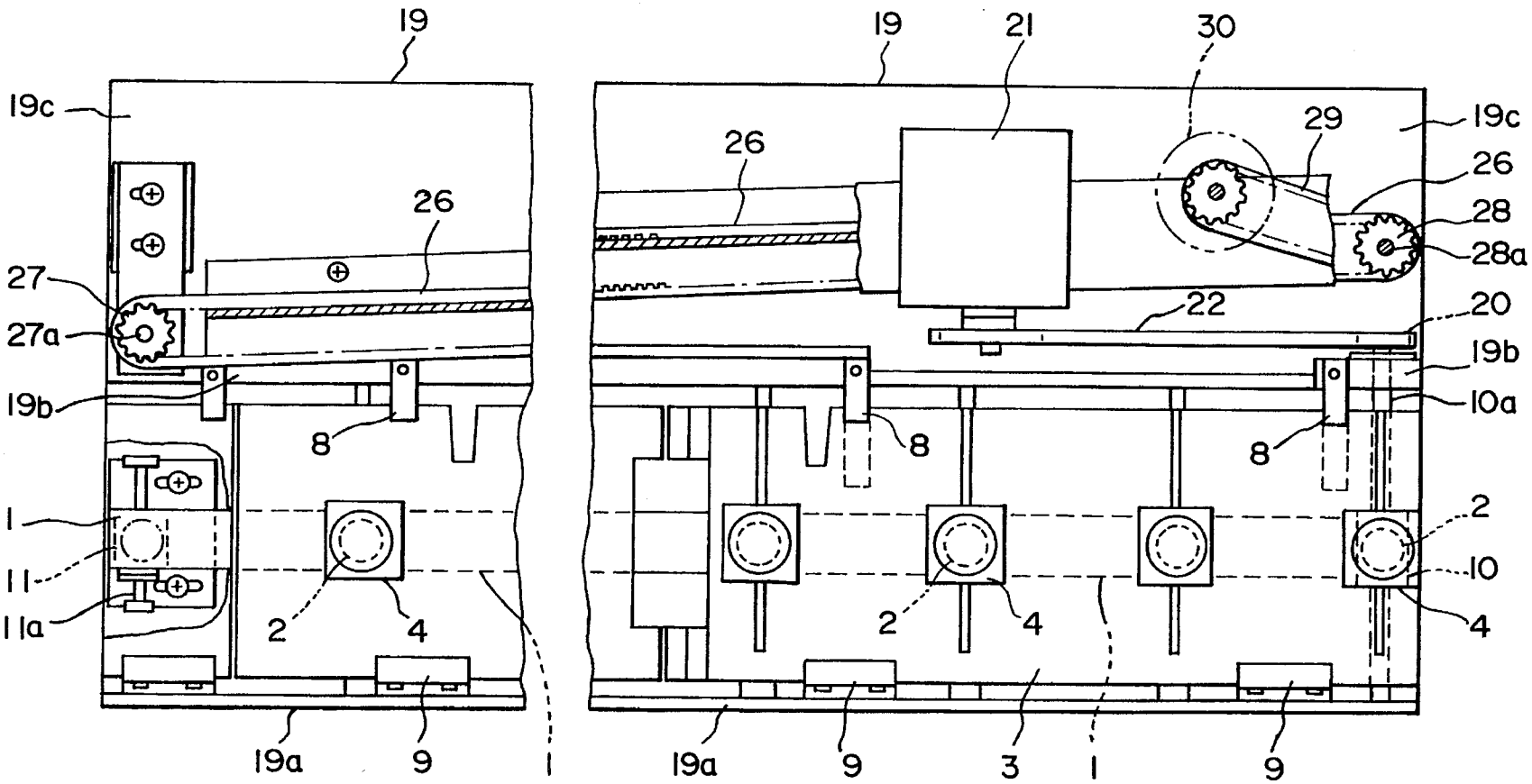
FIG. 3 is a view of bank note and coin conveying apparatus seen from the direction III in FIG. 2.

As shown in FIG. 2 and FIG. 3, the coin conveying apparatus is provided at the upper side of the shelf board 19*b* of the substrate 19. The coin conveying apparatus comprises a coin conveying endless belt 26 provided substantially in parallel to the direction in which a plurality of pachinko machines are arranged, a drive pulley 28 and a driven pulley 27, over which the coin conveying belt is put, a shaft 28*a* of a pulley 28, a shaft 27*a* of a pulley 27, a coin conveying motor 30 which rotates the shaft 28*a* of the drive pulley 28, and a transmitting belt 29 which connects a rotating axis of the coin conveying motor and the shaft 28*a* of the drive pulley 28. The shafts 28*a*, 27*a* of the respective pulleys 27, 28 are provided via a bearing (not shown) on the upright board 19*b* so as to extend horizontally. On the periphery of each of the pulleys 27, 28 over which the coin conveying belt 26 is put, a plurality of teeth are formed. The outer surface (where the coins come into contact) of the coin conveying belt 26 is formed to be smooth while the inner surface is formed with ribs to fit the teeth of the pulleys 27, 28.

Figure 6:
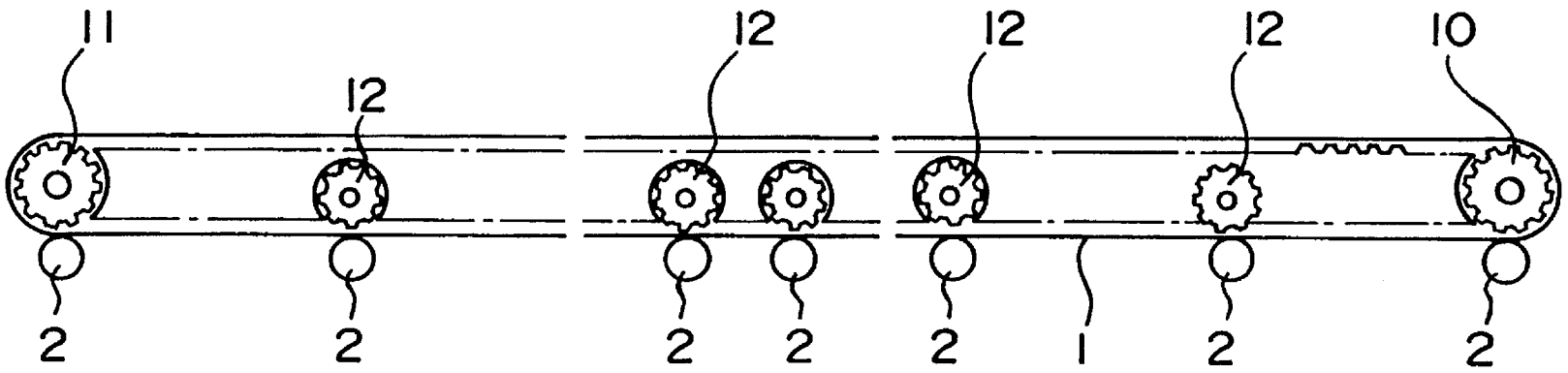
FIG. 6 is an explanatory top plane view of the bank note conveying apparatus in the embodiment of the present invention, wherein a bank note conveying path forming member is not shown.

The bank note conveying apparatus, as shown in FIG. 2 and FIG. 3, is provided between the base board 19*a* and the shelf board 19*b* of the substrate 19. The bank note conveying apparatus is for conveying the bank note A with the face of the bank note A extending substantially in parallel to a vertical direction and with the length of the bank note A extending substantially in parallel to a horizontal direction. The bank note conveying apparatus is provided so as to be in parallel to the direction in which the plurality of pachinko machines 13 are arranged, similar to a bank note conveying path forming member 3, and comprises a bank note conveying endless belt 1 which comes into contact with one of the two faces of the bank note A, balls 2 which come into contact with the other face of the bank note A, holders 4 which each supports a ball 2 so that it can rotate freely, belt supporting pulleys 12 (shown in FIG. 6) provided at the positions opposite the balls 2, sandwiching the bank note conveying belt 1 therebetween, and a belt driving mechanism which rotates the bank note conveying belt 1. The belt conveying mechanism comprises a drive pulley 10 and a driven pulley 11 over which the bank note conveying belt 1 is put; shafts 10*a*, 11*a* of the pulleys 10, 11; a bank note conveying motor 21 which rotates the shaft 10*a* of the drive pulley 10; and a transmitting belt 22 which joins the rotating axis of the bank note conveying motor 21 and the shaft 10*a* of the drive pulley 10. Among these constituents of the bank note conveying apparatus, the bank note conveying motor 21 and the transmitting belt 22 are provided at the upper side of the shelf board 19*b* of the substrate 19. The shafts 10*a*, 11*a* of the respective pulleys 10, 11 are provided via the bearing (not shown) at the side portion of the substrate 19 so that they will extend vertically. A plurality of teeth are formed at the peripheries of each of the pulleys 10, 11, 12 over which the bank note conveying belt 1 is put. The outer surface (where the bank notes come into contact) of the bank note conveying belt 1 is formed to be smooth while the inner surface is formed to have ribs to fit the teeth of the pulleys 10, 11, 12.

Figure 1:
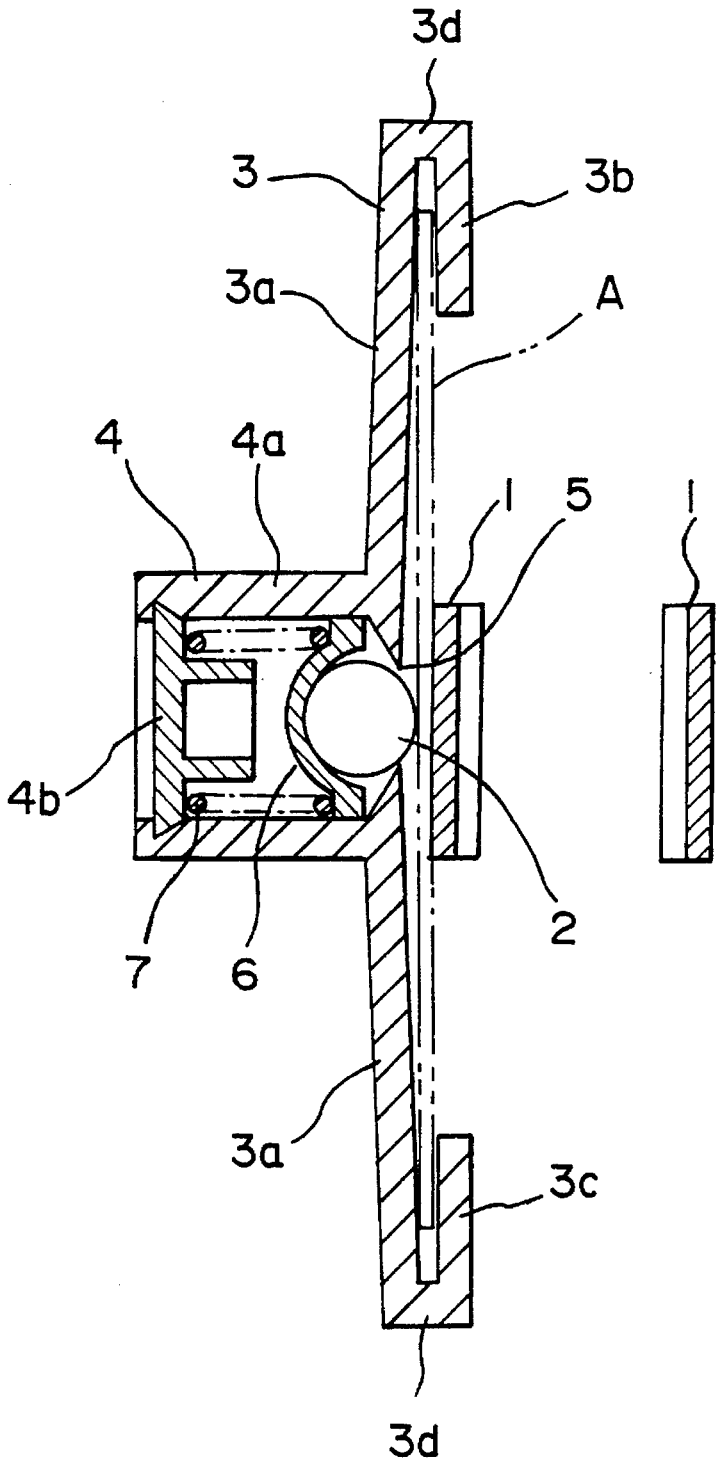
FIG. 1 is a cross sectional view of the main portion of the bank note conveying apparatus in an embodiment of the present invention.

The bank note conveying path forming member 3, as shown in FIG. 1, comprises a rear side guide section at the top (a first thickness direction position guide for the bank note), 3*b* which is to be in contact with an upper portion of one of the two faces of the bank note A, another rear side guide section at the bottom (another first thickness direction position guide for the bank note), 3*c* which comes into contact with a lower portion of said one of the two faces of the bank note A, a forward side guide section 3*a* (a second thicknesswise position guide for the bank note) which comes into contact with the other face of the bank note A, and a widthwise position guide section 3*d* which controls the position of the up/down direction of the bank note A, i.e. the position of the widthwise direction of the bank note A. In the present embodiment, as the bank note A is conveyed in the condition where its face is extending in the vertical direction, the forward side guide section 3*a* and the rear side guide sections 3*b*, 3*c* extend substantially in parallel to the vertical direction. However, the middle portion in the up/down direction of the forward side guide section 3*a* is slightly bent, i.e. curved forward when seen from the front. The bank note conveying belt 1 is positioned to face the forward side guide section 3*a* and between the rear side guide section at the top, 3*b*, and the rear side guide section 3*c*, at the bottom. At the central portion of the forward side guide section 1*a*, a circular opening 5 is formed. The opening 5 has a smaller diameter than the ball 2 so that while a portion of the ball 2 can project out therethrough, the ball 2 will not completely come out of it. At the front of the forward side guide section 3*a*, i.e. the opposite face of the bank note conveying belt 1, a holder 4 which supports the ball 2 to be freely rotatable is provided. The holder 4 comprises a spherical surface supporting member 6 which contacts a portion of the ball 2 which is opposite to the portion projected out from the opening 5 of the forward side guide section 3*c*, a coil spring 7 which urges the ball 2 and the spherical surface supporting member 6 in a direction to project a portion of the ball 2 through the opening 5 to come into contact with the bank note conveying belt 1, a spring fastener 4*b* which supports one end of the soil spring 7, a cylindrical casing 4*a* which houses these elements and the ball 2 to be movable to-and-fro with respect to the bank note conveying belt. As for the coil sprang 7, both the original length and the length of the stroke are longer than the length of the stroke of the ball within the casing 4*a*. The coil spring 7 is housed in the casing 4*a* in a compressed condition, wherein one end of the spring rests on the spring fastener 4*b* as mentioned above and the other end rests against the spherical surface supporting member 6.

Figure 4:
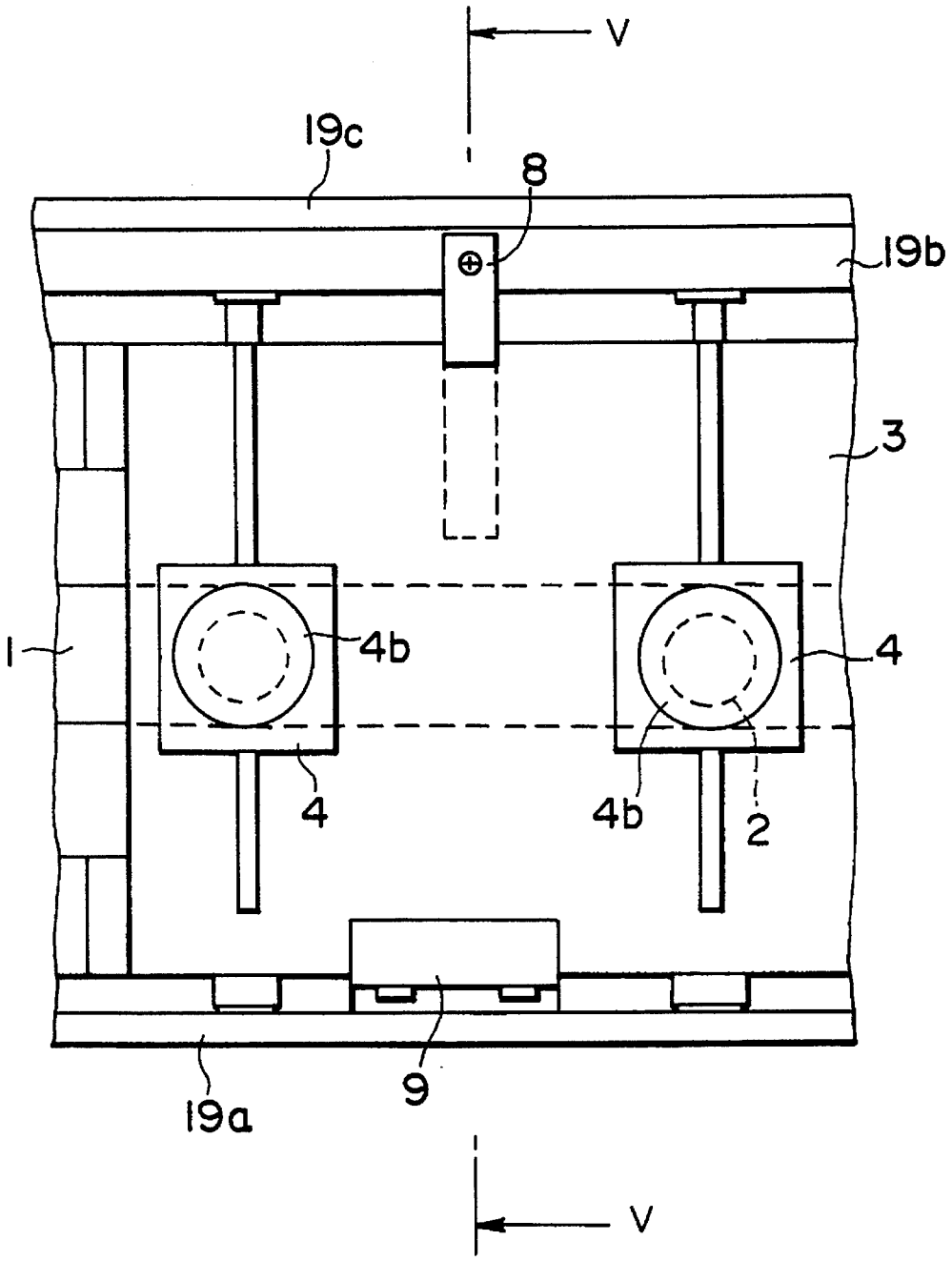
FIG. 4 is a detailed front view of the main portion of the bank note conveying apparatus in the embodiment of the present invention.

As shown in FIG. 4 and FIG. 5, the bank note conveying path forming member 3 has its top part supported by the leaf spring (one end supporting member) 8 and its bottom part supported by a path forming member fastener (opposite end supporting member) 9. One end of the leaf spring 8 is fixed to the shelf board 19*b* of the substrate 19 while the opposite end is formed in a shape to be engageable with the top part of the bank note conveying path forming member 3. The bank note conveying path forming member 3 is supported by the leaf spring 8 and the path forming member fastener 9 so that it may be displaced between a bank note conveyable position where the ball 2 supported by the holder 4 faces against the bank note conveying belt 1 and a repairable portion where the upper side of the bank note conveying path forming member 3 swings about the lower side to fall to the front.

Figure 7:
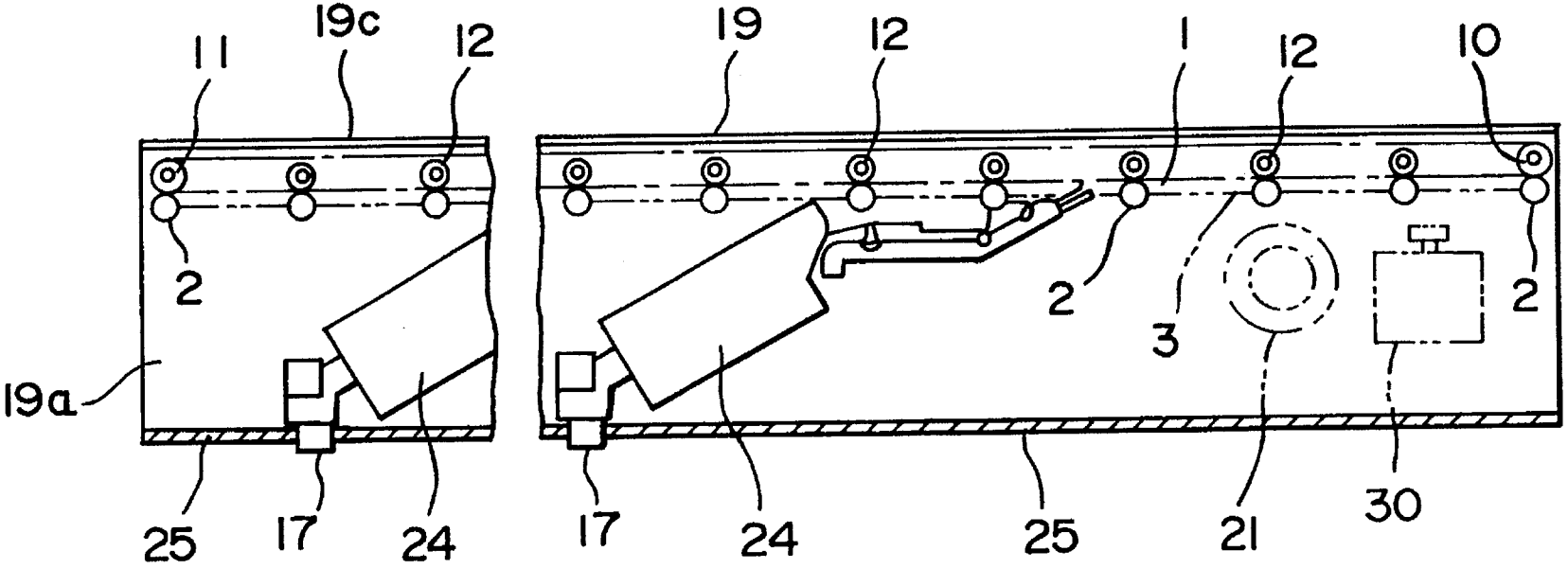
FIG. 7 is a top plane view of the bank note conveying apparatus and a bank note distinction apparatus, wherein a bank note conveying path forming member is not shown.
Figure 8:
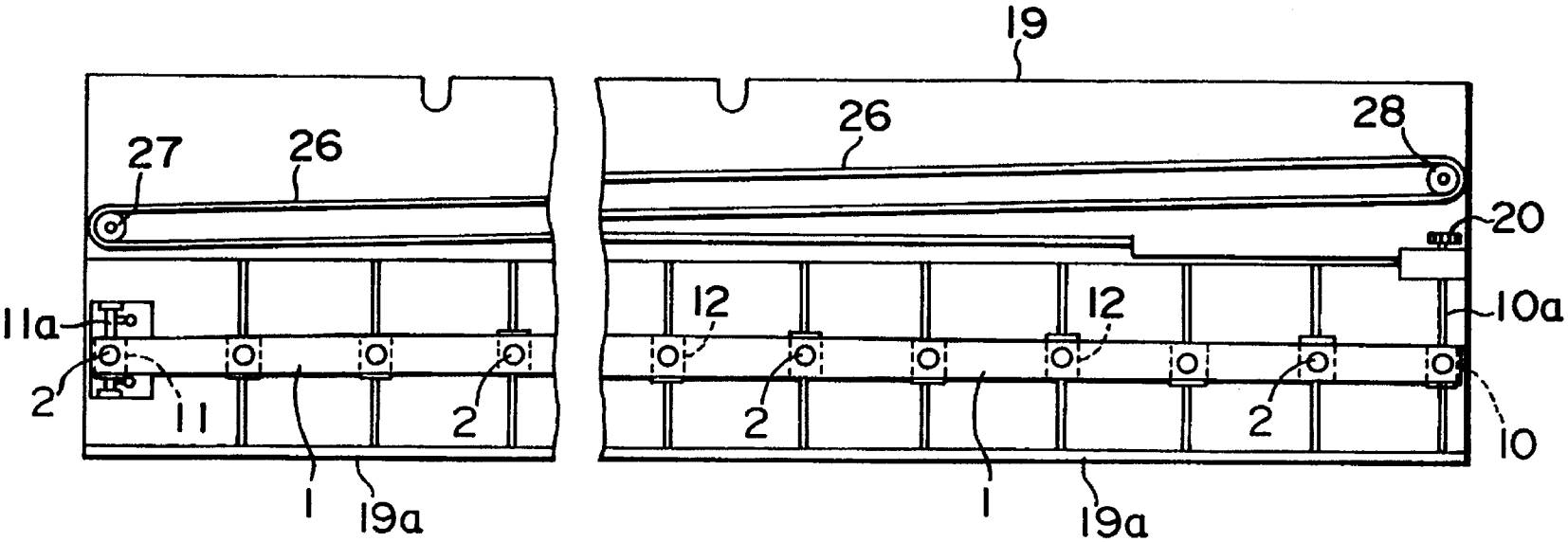
FIG. 8 is a front view of the bank note conveying apparatus and the coin conveying apparatus in the embodiment of the present invention, wherein a bank note conveying path forming member is not shown.

The bank note distinction apparatuses 24, as shown in FIG. 7, determine whether the bank notes A inserted from the bank note insertion slots 17 provided on the covering board 25 are, real, imitation, etc., and only the bank notes A determined to be real are conveyed into between the bank note conveying belt 1 and the balls 2.

The bank note conveying apparatus, the coin conveying apparatus, and two of the bank note distinction apparatuses 24 are provided for each unit as mentioned above. In the island decoration 12*a* provided at the end of the pachinko island B, a moneychanger, etc. are provided. In the moneychanger, there is provided a stacker which stores the bank notes conveyed by the bank note conveying apparatus and the coins conveyed by the coin conveying apparatus.

The operation of the bank note conveying apparatus of the present embodiment will now be explained.

When a bank note A is inserted from the bank note insertion slot 17, it is determined by the bank note distinction apparatus 24 as to whether the inserted bank note A is real, imitation, etc. If the bank note A is determined to be real, the bank note distinction apparatus 24 instructs the ball lending machine 14 to give out the number of pachinko balls corresponding to the money value of the bank note while supplying the bank note A to the bank note conveying apparatus.

From the bank note distinction apparatus 24, the bank notes A are supplied within the bank note conveying path defined by the bank note conveying path forming member 3 of the bank note conveying apparatus. The bank note A within the bank note conveying path has one of its two faces in contact with the conveying surface of the bank note conveying belt 1 and the opposite face in contact with the ball 2. The bank note A is pressed against the bank note conveying belt 1 by the ball 2 urged by the coil spring 7 in the direction toward the bank note conveying belt 1. As a result, the bank note A is conveyed within the bank note conveying path with rotation of the bank note conveying belt 1. When the bank note A is conveyed, by one bank note conveying apparatus provided for one unit composed by two pachinko machines 13, 13 and two ball lending machines 14, 14, to the end of the conveying apparatus, it is transferred to another bank note conveying apparatus provided at a succeeding adjacent unit, and finally to the moneychanger within the island decoration 15*a* provided at the end of the pachinko island B.

In the present invention, incidentally, the coil spring 7 is used as an resilient member for biasing the ball 2 towards the bank note conveying belt 1, instead of a leaf spring whose stroke length is limited by the thickness and size of the sprang, so that the stroke length can be determined comparatively freely. Therefore, the stroke length of the resilient member and the ball 2 can be increased, and this assures that the ball 2 is pressed to the bank note conveying belt 1 even if the holder 4 is mounted not so precisely against the bank note conveying belt 1. Thus, the bank note A is pinched firmly between the ball 2 and the bank note conveying belt 1, so that stable conveyance of the bank note A can be obtained. Especially, because the forward side guide member 3*a* of the bank note conveying path forming member is curved in the present embodiment, only the upper and lower sides of the bank note A are pressed by the upper and lower sides of the forward side guide member 3*a* while the center of the bank note A is pressed by the ball 2. Therefore, the pinching of the bank note A by the ball 2 is enhanced. In addition, since the bank note A is pressed for certain at three points, namely, the upper side, center, and the lower side, the bank note A can be conveyed more stably.

Further, in the present embodiment, a so-called timing belt, wherein the inner periphery is formed to have ribs, is used as each of the conveying belts 1, 26, so that the driving force of the motors 21, 30 is transmitted to the conveying belts 1, 26 respectively without any loss to convey the bank notes and coins efficiently.

Furthermore, in the present embodiment, as shown in FIG. 5, since the bank note conveying path forming member 3 is displaceable between a bank note conveyable position and a repairable position, so that for example if the bank note A gets caught in the ball 2 while being conveyed when the bank note conveying path forming member 3 is in the bank note conveyable position, the bank note A caught in the ball 2 can be released easily by widening the space between the ball 2 and the bank note conveying belt 1 by moving the bank note conveying path forming member to the repairable position.

What is claimed is:

1. A bank note conveying apparatus for conveying a bank note, said apparatus comprising:

an endless conveying belt provided to come into contact with one of two faces of said bank note;

a belt driving mechanism which rotates said endless conveying belt;

a ball provided to come into contact with the opposite face of said two faces of the bank note;

a holder which rotatably supports said ball;

said holder including a casing to house said ball therein while allowing the same to be movable to-and-fro relative to said endless conveying belt, and a coil spring provided within the casing in a compressed condition to urge the ball against the endless belt;

a bank note path forming member which controls the position and the direction of said bank note;

said bank note conveying path forming member including a first bank note thickness-direction-position guide section which extends to oppose one of the two faces of said bank note to control the thickness direction position of the bank note, a second bank note thickness-direction-position guide section which extends to oppose the other face of the two faces of said bank note to control the thickness direction position of the bank note, and a bank note widthwise-position guide section which controls the widthwise position of the bank note;

said first bank note thickness-direction-position guide section facing said one of the two faces of said bank note and being formed with an opening to allow said bank note conveying belt to come into contact with said one face of the bank note; and said second bank note thickness-direction-position guide section facing said other face of the two faces of the bank note and being formed with an opening having a smaller diameter than that of the ball so that the ball will partly but not completely project out towards the bank note conveying belt through the second bank note thickness-direction-position guide section.

2. A bank note conveying apparatus according to claim 1, further comprising:

a one end supporting member which disengageably supports one end of said bank note conveying path forming member in the widthwise direction of said bank note; and an opposite end supporting member which supports an opposite end of said bank note conveying path forming member so that said one end is able to swing around said opposite end as a pivot in a direction away from said bank note conveying belt.

3. A bank note conveying apparatus according to claim 2, wherein said second bank note thickness-direction-position guide section is curved so that a portion where said opening is formed is curved in a direction away from said bank note conveying belt.

4. A bank note conveying apparatus according to claim 2 wherein:

said belt driving mechanism comprises a drive pulley and a driven pulley over which said bank note conveying belt is put;

a plurality of teeth are mounted at the peripheries of said drive pulley and said driven pulley, respectively; and said bank note conveying belt has a surface which comes into contact with said one of the faces of said bank note and is formed to be smooth and has an inner surface which has ribs to engage with the teeth of said drive pulley and said driven pulley.

5. A bank note conveying apparatus according to claim 2, further comprising a belt supporting pulley which is in contact with an inner surface of said conveying belt which is opposite to a surface thereof which is in contact with said one of the two faces of the bank note, said belt supporting pulley being provided at a position where said bank note conveying belt is facing said ball for rotation with the driving of said bank note conveying belt.

6. A bank note conveying apparatus according to claim 1, wherein said second bank note thickness-direction-position guide section is curved so that a portion where said opening is formed is curved in a direction away from said bank note conveying belt.

7. A bank note conveying apparatus according claim 1 wherein:

said belt driving mechanism comprises a drive pulley and a driven pulley over which said bank note conveying belt is put;

a plurality of teeth are formed at the peripheries of said drive pulley and said driven pulley, respectively; and said bank note conveying belt has a surface which comes into contact with said one of the faces of said bank note and is formed to be smooth and has an inner surface which has ribs to engage with the teeth of said drive pulley and said driven pulley.

8. A bank note conveying apparatus according to claim 1, further comprising a belt supporting pulley which is in contact with an inner surface of said conveying belt which is opposite to a surface thereof which is in contact with said one of the two faces of the bank note, said belt supporting pulley being provided at a position where said bank note conveying belt is facing said ball for rotation with the driving of said bank note conveying belt.

* * * * *